US011018431B2

(12) United States Patent
Rogers

(10) Patent No.: US 11,018,431 B2
(45) Date of Patent: May 25, 2021

(54) CONFORMAL PLANAR DIPOLE ANTENNA

(71) Applicant: The Boeing Company, Chicago, IL (US)

(72) Inventor: John E. Rogers, Owens Cross Roads, AL (US)

(73) Assignee: The Boeing Company, Chicago, IL (US)

( * ) Notice: Subject to any disclaimer, the term of this patent is extended or adjusted under 35 U.S.C. 154(b) by 172 days.

(21) Appl. No.: 16/238,447

(22) Filed: Jan. 2, 2019

(65) Prior Publication Data

US 2020/0212582 A1 Jul. 2, 2020

(51) Int. Cl.

| | |
|---|---|
| ***H01Q 9/28*** | (2006.01) |
| ***H01Q 9/06*** | (2006.01) |
| ***H01Q 9/04*** | (2006.01) |
| ***H01Q 21/06*** | (2006.01) |
| ***H01Q 1/28*** | (2006.01) |
| *H01Q 21/00* | (2006.01) |

(52) U.S. Cl.

CPC ..... *H01Q 9/285* (2013.01); *H01Q 1/286* (2013.01); *H01Q 9/0428* (2013.01); *H01Q 9/065* (2013.01); *H01Q 21/062* (2013.01); *H01Q 21/0075* (2013.01)

(58) Field of Classification Search

CPC ..... H01Q 9/065; H01Q 1/286; H01Q 9/285; H01Q 21/062; H01Q 9/0428; H01Q 13/206; H01Q 21/0075

See application file for complete search history.

(56) References Cited

U.S. PATENT DOCUMENTS 4,054,874 A * 10/1977 Oltman, Jr. ..... H01Q 9/0457 343/700 MS
4,660,047 A * 4/1987 Wolfson ..... H01Q 9/065 343/700 MS
4,710,775 A * 12/1987 Coe ..... H01Q 13/18 343/727
4,740,793 A * 4/1988 Wolfson ..... H01Q 9/065 343/700 MS
5,021,799 A * 6/1991 Kobus ..... H01Q 9/285 343/795
5,400,042 A * 3/1995 Tulintseff ..... H01Q 21/24 343/727

(Continued)

OTHER PUBLICATIONS

Cook et al., "Multilayer Inkjet Printing of Millimeter-Wave Proximity-Fed Patch Arrays on Flexible Substrates," IEEE Antennas and Wireless Propagation Letters, Oct. 16, 2013, pp. 1351-1354, vol. 12.

(Continued)

*Primary Examiner* — Graham P Smith
*Assistant Examiner* — Jae K Kim
(74) *Attorney, Agent, or Firm* — Haynes and Boone, LLP

(57) ABSTRACT

Systems and methods for a conformal planar dipole antenna is described herein. In one example, the antenna can include a first dipole layer, a second dipole layer, a microstrip layer, and a ground plane. The first dipole layer can include a first antenna element. The second dipole layer can include a second antenna element. The microstrip layer can include a microstrip. The first antenna element, the second antenna element, and the microstrip can be electrically coupled to each other.

20 Claims, 9 Drawing Sheets

(56) References Cited

U.S. PATENT DOCUMENTS 5,485,167 A * 1/1996 Wong ..... H01Q 21/062 343/753
5,486,837 A * 1/1996 Miller ..... H01Q 13/26 343/780
6,351,247 B1 * 2/2002 Linstrom ..... H01Q 3/46 342/368
8,217,847 B2 * 7/2012 Sotelo ..... H01Q 15/0046 343/755
9,640,858 B1 * 5/2017 Islam ..... H01Q 21/20
2001/0028328 A1 * 10/2001 Stjernman ..... H01Q 3/46 343/761
2001/0050654 A1 * 12/2001 Killen ..... H01Q 5/49 343/817
2005/0151693 A1 * 7/2005 Schantz ..... H01Q 13/10 343/767
2007/0290938 A1 * 12/2007 Loyet ..... H01Q 5/42 343/795
2007/0297398 A1 * 12/2007 Loyet ..... H01Q 5/321 370/382
2008/0238800 A1 * 10/2008 Collins ..... H01Q 23/00 343/795
2009/0079653 A1 * 3/2009 Semonov ..... H01Q 9/28 343/793
2009/0195471 A1 * 8/2009 Semonov ..... H01Q 19/30 343/810
2010/0321238 A1 * 12/2010 Shen ..... H01Q 21/061 342/373
2011/0032164 A1 * 2/2011 Villarroel ..... H01Q 1/3275 343/713
2011/0090131 A1 * 4/2011 Chen ..... H01Q 19/30 343/815
2011/0316734 A1 * 12/2011 Svensson ..... H01Q 13/10 342/175
2012/0293387 A1 * 11/2012 Ohno ..... H01Q 9/285 343/818
2013/0027268 A1 * 1/2013 Ohno ..... H01Q 9/285 343/818
2013/0170020 A1 * 7/2013 Davis ..... H01Q 15/002 359/350
2017/0179578 A1 * 6/2017 Semonov ..... H01Q 1/38
2017/0179596 A1 * 6/2017 Diaz ..... H01Q 19/104
2017/0222325 A1 * 8/2017 Sudo ..... H01Q 9/0457

OTHER PUBLICATIONS

Croq et al., "Multifrequency Operation of Microstrip Antennas Using Aperture Coupled Parallel Resonators," IEEE Transactions on Antennas and Propagation, Nov. 1992, pp. 1367-1374, vol. 40, No. 11.

Iwasaki, Hisao, "A Circularly Polarized Small-Size Microstrip Antenna with a Cross Slot," IEEE Transactions on Antennas and Propagation, Oct. 1996, pp. 1399-1401, vol. 44, No. 10.

Maci et al., "Dual-Frequency Patch Antennas," IEEE Antennas and Propagation Magazine, Dec. 1997, pp. 13-20, vol. 39, No. 6.

Munson, Robert E., "Conformal Microstrip Antennas and Microstrip Phased Arrays," IEEE Transactions on Antennas and Propagation, Jan. 1974, pp. 74-78.

Oltman, H. George, "Electromagnetically Coupled Microstrip Dipole Antenna Elements," IEEE 8$^{th}$ European Microwave Conference, Sep. 4-8, 1978, pp. 281-285, Paris, France.

Pozar et al., "Increasing the Bandwidth of a Microstrip Antenna by Proximity Coupling," Electronics Letter, Apr. 9, 1987, pp. 368-369, vol. 23, No. 8.

Pozar, D. M., "Microstrip Antenna Aperture-Coupled to a Microstripline," Electronics Letters, Jan. 17, 1985, pp. 49-50, vol. 21, No. 2.

Suh et al., "Low Cost Microstrip-Fed Dual Frequency Printed Dipole Antenna for Wireless Communications," Electronics Letter, Jul. 6, 2000, pp. 1177-1179, vol. 36, No. 14.

Yang et al., "Analysis of an Aperture Coupled Dipole Antenna, A Microstrip Fed Slot and a Slotline Fed Dipole," IEEE Antennas and Propagation Society International Symposium, Jun. 15-19, 1987, pp. 924-927.

* cited by examiner

600A

600B

CONFORMAL PLANAR DIPOLE ANTENNA

TECHNICAL FIELD

The disclosure relates generally to signal transmission and receiving systems and more specifically to an antenna that includes a microstrip and dipole antenna elements configured to cause circular polarization of signals emitted by the antenna.

BACKGROUND

The exterior surfaces of aircraft and other vehicles often include non-planar surfaces. Unmanned aerial vehicles (UAVs), in particular, feature surfaces with low radii of curvature due to the compact size of UAVs. Regardless of the type of vehicle though, light weight antennas with low air drag for improved efficiency are beneficial. Low radar cross section is also desirable in certain applications. Thus, there is a need for antennas capable of conforming to non-planar surfaces that are efficient and provide minimal signal loss.

Existing planar patch and dipole antennas are inherently bandwidth-limited due to their resonant natures. Additionally, such antennas suffer from polarization loss due to their sensitivity to the orientations between the transmitting and receiving antennas. Furthermore, pin fed antennas are not recommended for conformal applications on curved surfaces due to the additional signal losses through electrical vias during conformal bending. Thus, improved conformal planar antennas are desirable.

SUMMARY

Systems and methods are disclosed for a conformal planar dipole antenna. In a certain example, an antenna can be disclosed. The antenna can include a ground plane layer, a microstrip layer, a first dipole layer, and a second dipole layer. The microstrip layer can include a microstrip embedded within a composite substrate and disposed above the ground plane. The second dipole layer can be disposed above the microstrip layer and can include a second dipole antenna element electrically coupled to the microstrip, disposed over at least a portion of the microstrip, and oriented in a second direction. The first dipole layer can be disposed above the second dipole layer and can include a first dipole antenna element electrically coupled to the microstrip, disposed over at least a portion of the second dipole antenna element, and oriented in a first direction different from the second direction.

In another example, an antenna array can be disclosed. The antenna array can include a ground plane layer, a microstrip layer, a second dipole layer, and a first dipole layer. The microstrip layer can include a microstrip embedded within a composite substrate and disposed above the ground plane layer. The microstrip can include a feed network. The second dipole layer can be disposed above the microstrip layer and can include a plurality of second dipole antenna elements, where each of the second dipole antenna elements is electrically coupled to the microstrip, disposed over a portion of the microstrip, and oriented in a second direction. The first dipole layer can be disposed above the second dipole layer and can include a plurality of first dipole antenna elements, where each of the first dipole antenna elements is electrically coupled to the microstrip, disposed over a portion of one of the second dipole antenna elements, and oriented in a first direction different from the second direction.

The scope of the invention is defined by the claims, which are incorporated into this section by reference. A more complete understanding of the disclosure will be afforded to those skilled in the art, as well as a realization of additional advantages thereof, by a consideration of the following detailed description of one or more implementations. Reference will be made to the appended sheets of drawings that will first be described briefly.

BRIEF DESCRIPTION OF THE DRAWINGS

Examples of the disclosure and their advantages are best understood by referring to the detailed description that follows. It should be appreciated that like reference numerals are used to identify like elements illustrated in one or more of the figures.

DETAILED DESCRIPTION

Various examples of conformal antennas are described herein. Such RF assemblies can include a ground plane layer (disposed below a fourth dielectric layer), a microstrip layer (disposed above a third dielectric layer), a second dipole layer (disposed above a second dielectric layer), and a first dipole layer (disposed above a first dielectric layer). The four dielectric layers can alternatively be referred to as the composite dielectric. The microstrip layer can include a microstrip embedded within a composite substrate and disposed above the ground plane. The second dipole layer can be disposed above the microstrip layer and can include a second dipole antenna element electrically coupled to the microstrip, disposed over at least a portion of the microstrip, and oriented in a second direction. The first dipole layer can be disposed above the second dipole layer and can include a first dipole antenna element electrically coupled to the microstrip, disposed over at least a portion of the second dipole antenna element, and oriented in a first direction different from the second direction.

The antenna of various examples described herein can allow for a low-profile, conformal antenna. Such an antenna can be low in size, weight, and power (SWaP), which is desirable for many applications. The antenna can also conform to various flat and/or curved surfaces on both the exterior and interior (e.g., cabin) of an aircraft, including surfaces with a low radii of curvature. Furthermore, the antenna is agnostic (e.g., electrical performance does not change) to conductive surfaces such as an aircraft wing or fuselage.

The disclosed antenna offers various advantages over existing antennas. For example and without limitation, the disclosed antenna can include a radio frequency (RF) microstrip feed network electrically coupled to a ground plane for efficient signal propagation. Such a configuration allows for a simplification of the electrical configuration of the antenna. The ground plane can minimize changes in the antenna's electrical behavior resulting from conductive surfaces located proximate the antenna. Furthermore, the disclosed antenna includes electrically coupled dipole antenna elements. Such antenna elements allow for simple feeding of electrical signals. The coupled dipole antenna elements also allow for increased bandwidth with reduced polarization loss. Furthermore, the coupled dipole antenna elements allow for reduced signal loss during conformal bending.

The disclosed antenna can be arranged in a planar manner with multiple layers stacked on top of each other. Such an arrangement can reduce incidences of antenna failure due to conformal bending and can simplify fabrication by, for example, eliminating the use of electrical vias within the antenna. Electrical coupling of the various layers can be performed through thin RF dielectrics by the dipole antenna elements.

Figure 1:
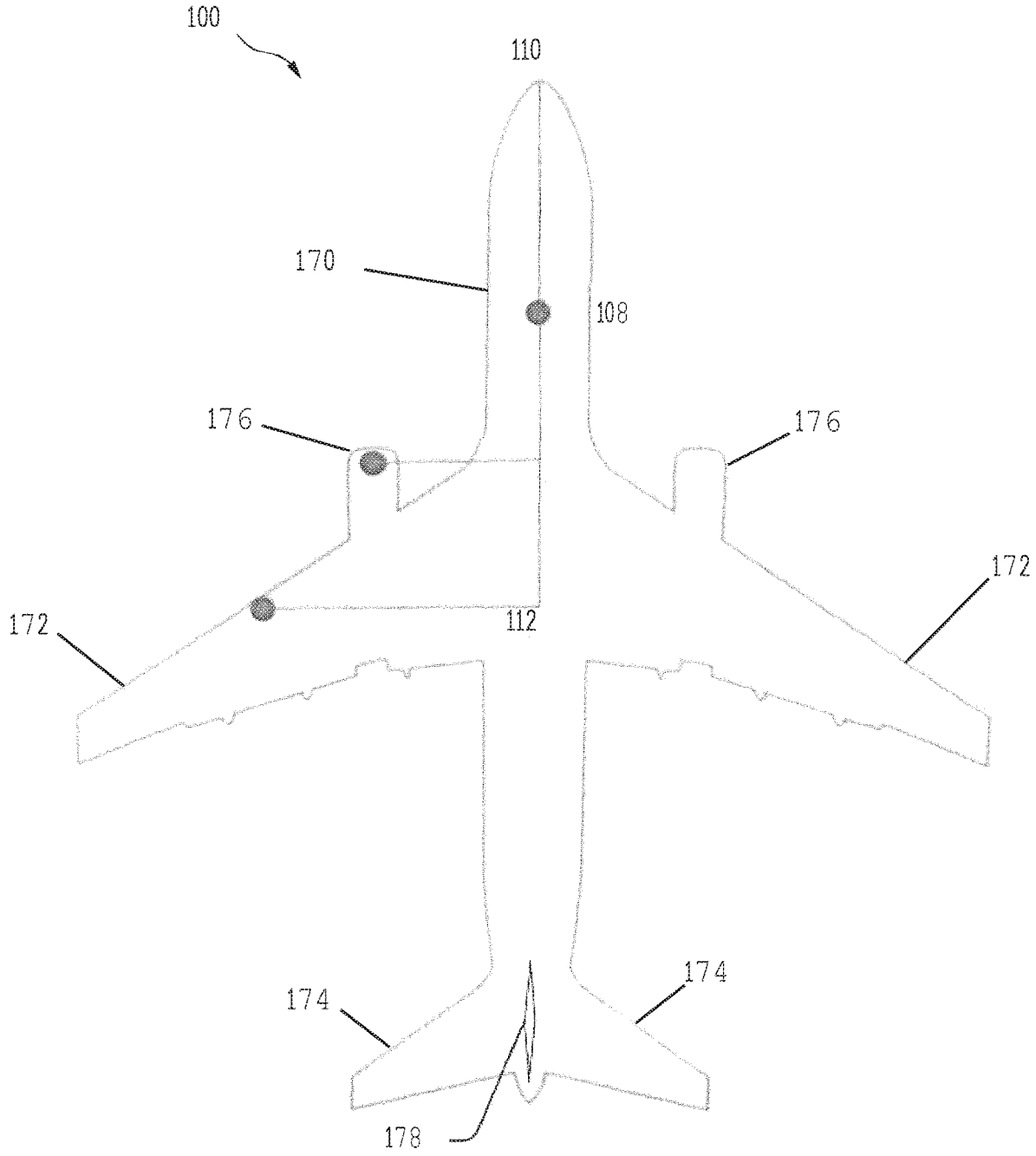
FIG. 1 illustrates an aircraft in accordance with an example of the disclosure.

FIG. 1 illustrates an aircraft in accordance with an example of the disclosure. The aircraft 100 of FIG. 1 can include fuselage 170, wings 172, horizontal stabilizers 174, aircraft engines 176, and vertical stabilizer 178. Additionally, aircraft 100 can include communications electronics 110, controller 108, and communications channel 112.

Aircraft 100 described in FIG. 1 is exemplary and it is appreciated that in other examples, aircraft 100 can include more or less components or include alternate configurations. Additionally, concepts described herein can be extended to other aircraft such as helicopters, drones, missiles, etc.

Communications electronics 110 can be electronics for communication between aircraft 100 and other mobile or immobile structures (e.g., other aircrafts, vehicles, buildings, satellites, or other such structures). Communications electronics 110 can be disposed within fuselage 170, wings 172, horizontal stabilizers 174, vertical stabilizer 178, and/or another portion of aircraft 100. Communications electronics 110 can include an antenna for sending and receiving signals. Examples of various antenna configurations are described herein.

Communications channel 112 can allow for communications between controller 108 and various other systems of aircraft 100. Accordingly, communications channel 112 can link various components of aircraft 100 to the controller 108. Communications channel 112 can, for example, be either a wired or a wireless communications system.

Controller 108 can include, for example, a microprocessor, a microcontroller, a signal processing device, a memory storage device, and/or any additional devices to perform any of the various operations described herein. In various examples, controller 108 and/or its associated operations can be implemented as a single device or multiple connected devices (e.g., communicatively linked through wired or wireless connections such as communications channel 112) to collectively constitute controller 108.

Controller 108 can include one or more memory components or devices to store data and information. The memory can include volatile and non-volatile memory. Examples of such memory include RAM (Random Access Memory), ROM (Read-Only Memory), EEPROM (Electrically-Erasable Read-Only Memory), flash memory, or other types of memory. In certain examples, controller 108 can be adapted to execute instructions stored within the memory to perform various methods and processes described herein, including implementation and execution of control algorithms responsive to sensor and/or operator (e.g., flight crew) inputs.

Figure 2:
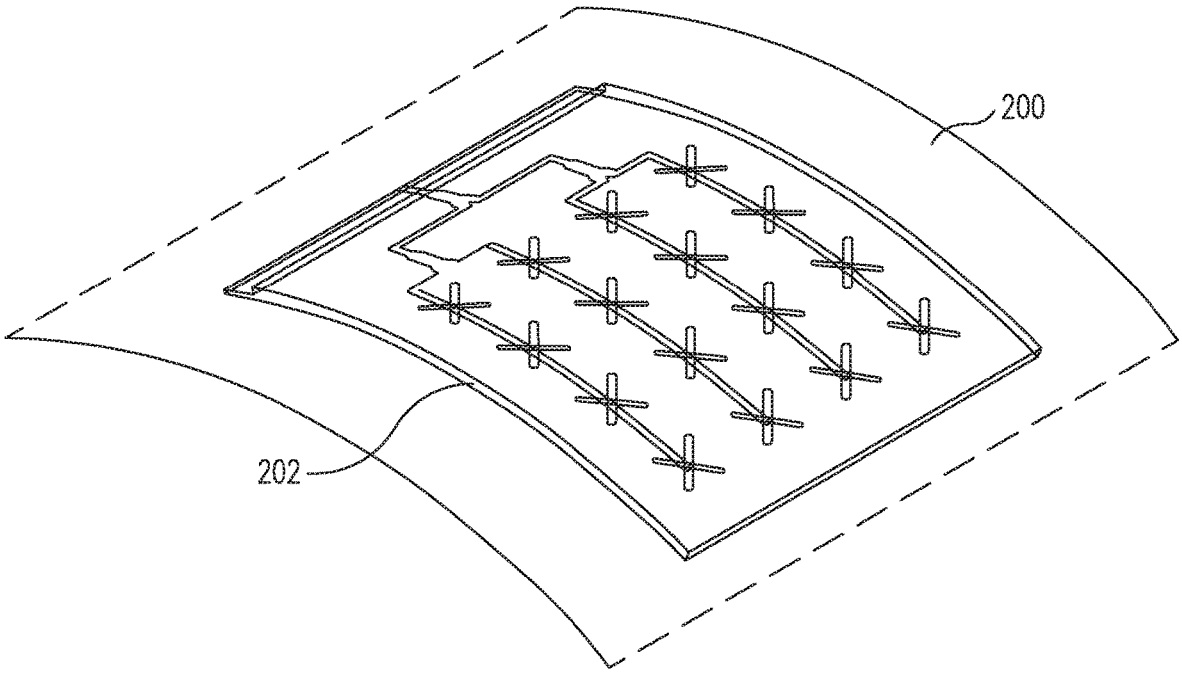
FIG. 2 illustrates a conformal antenna in accordance with an example of the disclosure.

FIG. 2 illustrates a conformal antenna in accordance with an example of the disclosure. Antenna 202 of FIG. 2 can be disposed on a surface 200 of an aircraft. In certain examples, surface 200 can be a curved surface. Antenna 202 can reliably conform to such a curved surface.

For example, unmanned aerial vehicles (UAVs) have conformal surfaces with low radii of curvature. Antenna 202 can be disposed on such surfaces and conform to the curvature without failure of antenna elements, resulting in an antenna with low air drag and low radar cross sections. Antenna 202 can include one or more of the features described herein to allow for effective transmitting and receiving of signals while conforming to a curved surface.

Figure 3:
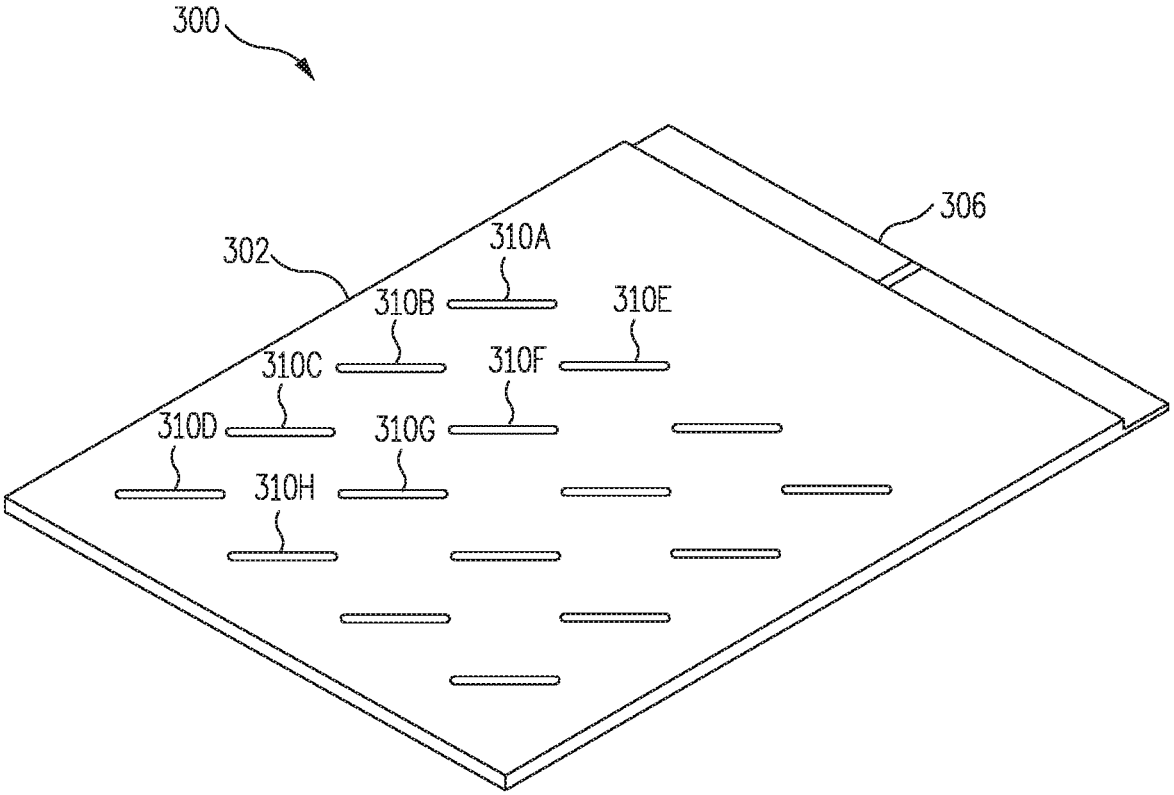
FIG. 3 illustrates a section of a conformal antenna in accordance with an example of the disclosure.

FIG. 3 illustrates a section of a conformal antenna in accordance with an example of the disclosure. FIG. 3 illustrates an antenna 300 or portion thereof. Antenna 300 can be a conformal planar multi-layer antenna. Antenna 300 can include a plurality of dielectric layers including first dielectric layer 302 and second dielectric layer 304 (not shown in FIG. 3, but shown in FIG. 4) and third dielectric layer 306.

In certain examples, each of the first and second dielectric layers 302 and 304, respectively, can include one or more antenna elements. For example, first dielectric layer 302 can include antenna elements 310A-H as well as other antenna elements. Antenna elements 310A-H can include conductive elements, slits formed within conductive elements, and/or other structures. Antenna elements 310A-H can include an orientation (e.g., along a major length). Such orientations can affect the transmission and/or receiving of signals by antenna 300.

Figure 4:
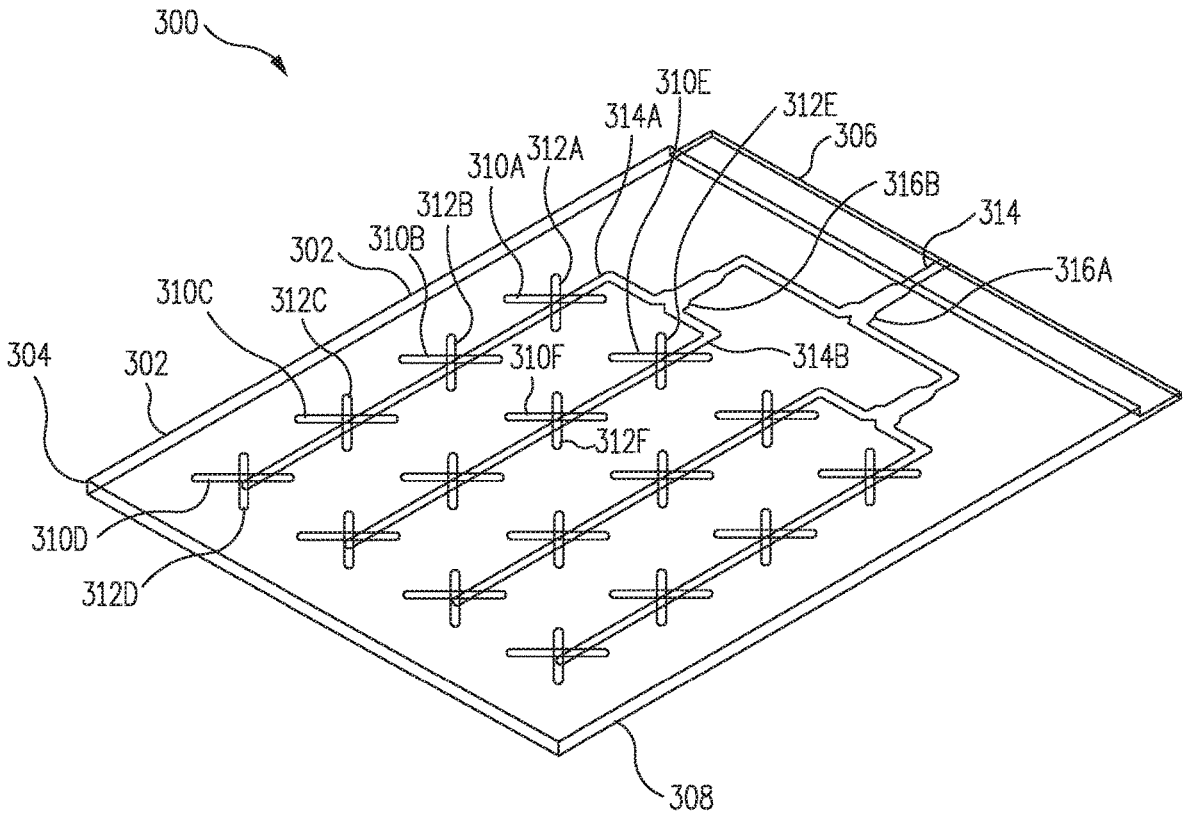
FIG. 4 illustrates a transparent view of a conformal antenna in accordance with an example of the disclosure.

The configuration of antenna 300 can be further described in FIG. 4. FIG. 4 illustrates a transparent view of a conformal antenna in accordance with an example of the disclosure. The view of FIG. 4 illustrates antenna 300 with first dielectric layer 302, second dielectric layer 304, third dielectric layer 306, and fourth dielectric layer 308. First dielectric layer 302 can include antenna elements 310A-F. Second dielectric layer 304 can include antenna elements 312A-F and can be disposed below first dielectric layer 302. Third dielectric layer 306 can include microstrip 314 and can be disposed below second dielectric layer 304. Fourth dielectric layer 308 can be disposed below third dielectric layer 306 and can include a ground plane (not shown in FIG. 4, but shown in FIGS. 7 and 8).

At least one of the individual elements of antenna elements 310A-F (first dipole layer) can be paired with an individual element of antenna element 312A-F (second dipole layer) to form an antenna element pair. That is, antenna elements 310A and 312A can form an electrically coupled dipole antenna element. Antenna elements 310A and 312A can also be electrically coupled to microstrip 314 (microstrip layer). For the purposes of this disclosure, a plurality of elements that are "electrically coupled" can refer to configurations where at least one of the elements electrically affect at least another of the elements. That is, for example, a current signal can be passed between the two elements. In certain examples, the current signal can be modified by one of the elements, or each element can be merely a conduit for the current signal.

Thus, an electrical power signal can be transmitted or received through antenna elements 310A and 312A (e.g., passed through an opening or through portions thereof). Such electrical power signals can be passed through microstrip 314 before transmission by or after being received by antenna elements 310A and 312A. Accordingly, in certain examples, at least a portion of antenna elements 310A and 312A are disposed over microstrip 314 and over each other.

In certain examples, at least a portion of antenna element 310A can be disposed over a portion of antenna element 312A. Other elements of antenna elements 310A-F can also be accordingly disposed over corresponding elements of antenna elements 312A-F. In certain examples, the combination of an antenna element 310 with its corresponding antenna element 312 can cause circular polarization of current signals. That is, each dipole antenna element can cause effective circular rotation of the current of electrical signals transmitted by the dipole antenna element. Circular polarization of electrical signals can lower power loss and, thus, improve signals transmission or reception.

Dipole antenna elements can induce circular polarization through the configuration of the individual antenna elements of the dipole antenna element. For example, each of antenna elements 310A-F and 312A-F can include an elongated element. The elongated element of each of antenna element 310A-F can be oriented at an angle to the corresponding elongated element of the corresponding antenna element 312A-F. For example, the elongated elements of the antenna elements of each dipole antenna element can each include a major length (e.g., a longer length of the element) that can be oriented at substantially (e.g., +/−10 percent) 90 degrees to each other. Other orientations (e.g., substantially 60 degrees, 45 degrees, 30 degrees, or other angles) can also be used. Orienting one of the elongated element at an angle to the other elongated element can induce circular polarization.

In various examples, antenna elements 310A-F and 312A-F can include a conductive element (e.g., a conductive strip). Such a conductive element can be, for example, the elongated element. As shown, antenna elements 310A-F and 312A-F are substantially linear and/or rectangular elements, but other shapes of conductive elements are also contemplated. Antenna elements 310A-F and 312A-F, as well as microstrip 314, can be embedded in their respective corresponding layers. In certain examples, antenna elements 310A-F can be referred to as a surface element, while antenna elements 312A-F can be referred to as an embedded element. Other examples can embed both antenna elements 310A-F and 312A-F within the composite substrate.

Microstrip 314 can also be a conductive element or strip. An electrical power signal can be supplied to microstrip 314 by, for example, a transmitter. In various examples, the dipole antenna elements can be arranged in an array such as a grid array (e.g., a 4×4 array as shown in FIG. 4, though other array positions and configurations are also contemplated). Microstrip 314 can be configured to power each of the dipole antenna elements in the grid array. For example, microstrip 314 can include power dividers 316A and 316B to allow microstrip 314 to split from a single strip to multiple strips at certain portions of microstrip 314. Multiple power dividers can be used to evenly split power.

Portions of microstrip 314 can be disposed below dipole antenna elements and electrically couple to the dipole antenna elements. To transmit signals, an electrical power signal can be supplied to microstrip 314. The current is then electrically coupled to dipole antenna elements. The orientation of the dipole antenna elements can cause the current coupled from microstrip 314 to circularly rotate within at least a portion of one or more antenna elements. Such current can accordingly be electrically coupled to free-space (e.g., transmit) to other antennas (e.g., receiving antennas). Similarly, signals can be received by the antenna elements of the dipole antenna element. Signals received can then be electrically coupled to microstrip 314, which can then provide the signals to, for example, a receiver.

The fourth dielectric layer 308 (including ground plane 320) can be disposed below the third dielectric layer 306. Ground plane 320 can minimize any changes in electrical behavior of antenna 300 (e.g., changes due to the presence of conductive surfaces such as the aluminum and/or composite surfaces of aircrafts). In certain examples, ground plane 320 can be electrically coupled to one or more other elements of antenna 300 (e.g., electrically coupled to microstrip 314, antenna elements 310A-F, and/or antenna elements 312A-F).

Figure 5:
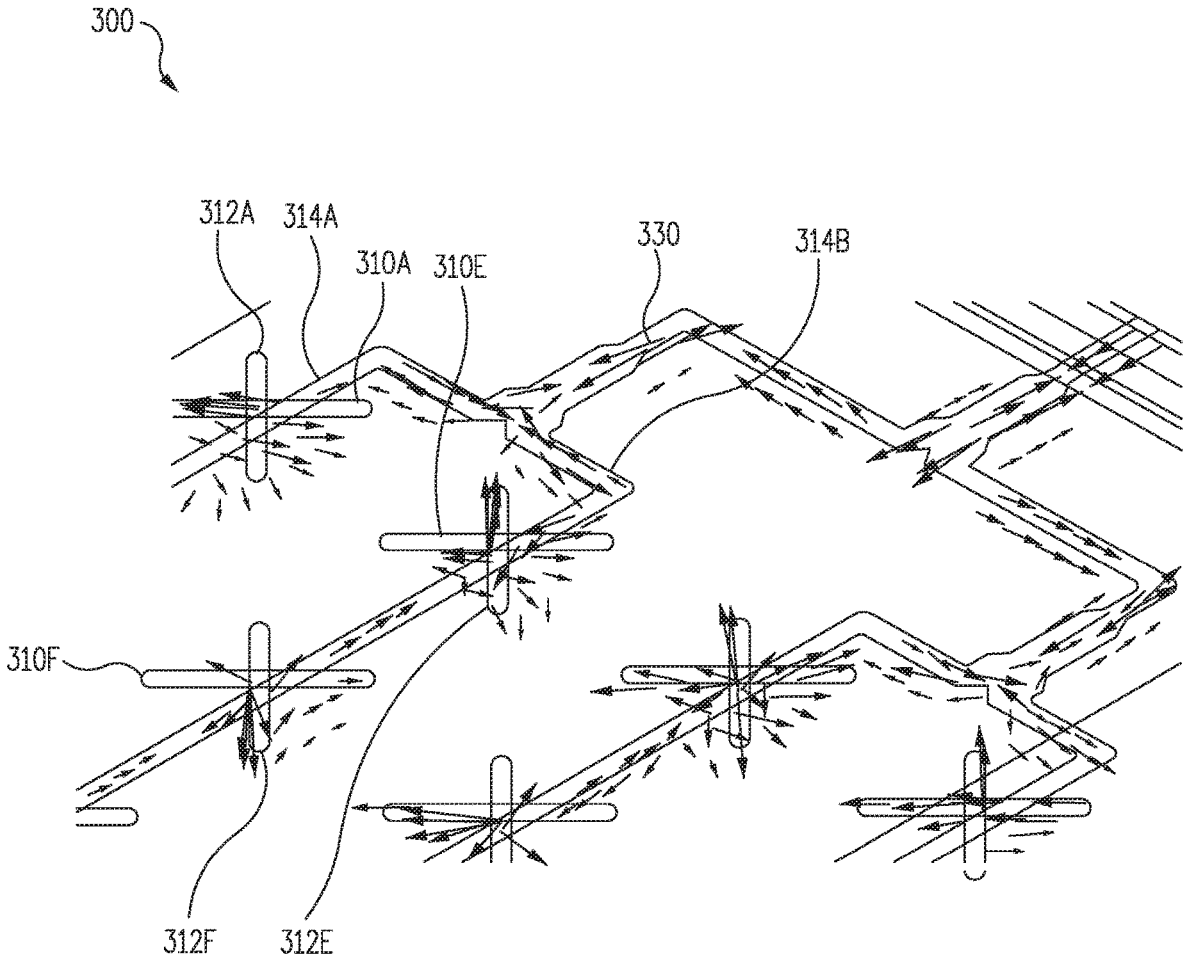
FIG. 5 illustrates a transparent view of a conformal antenna in accordance with another example of the disclosure.

Operation of antenna 300 can be further illustrated in FIG. 5. FIG. 5 illustrates a transparent view of a conformal antenna in accordance with another example of the disclosure. The arrows in FIG. 5 illustrate directions of current flow within antenna 300. As shown, the orientation of antenna elements 310A-F and antenna elements 312A-F result in circular polarization of the current within the antenna elements and, thus, within each dipole antenna element.

Accordingly, as shown in FIG. 5, current can travel through microstrip 314. The current can then electrically couple from microstrip 314 to the antenna elements 310A-F and 312A-F. The coupling between each of antenna element 310 with the corresponding antenna element 312 (e.g., between antenna element 310A and antenna element 312A) can cause the circular rotation of the current that results in circular polarization.

Figure 6A:
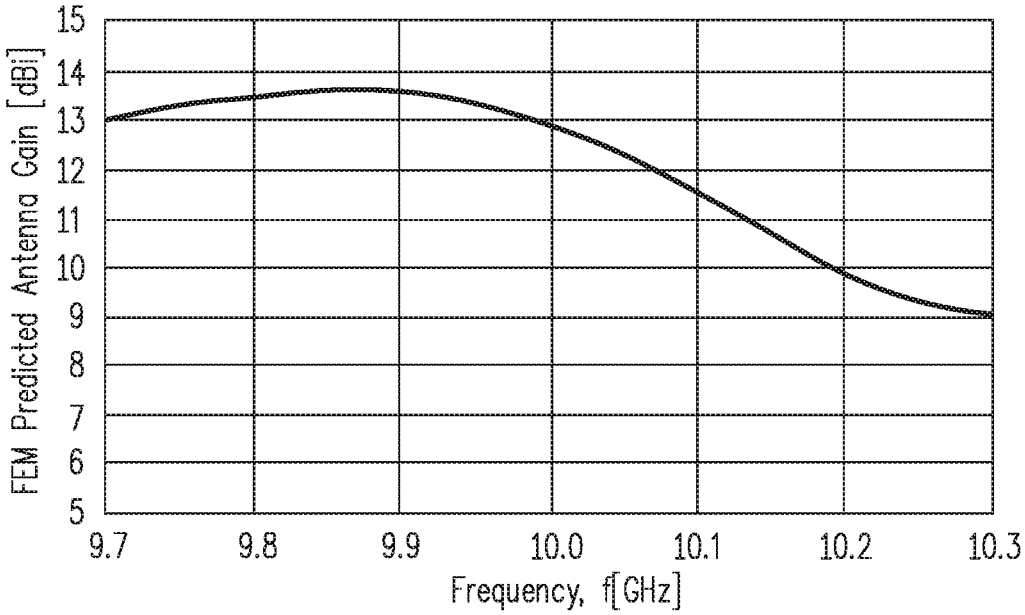
FIGS. 6A and 6B are illustrations of the performance of conformal antennas in accordance with examples of the disclosure.
Figure 6B:
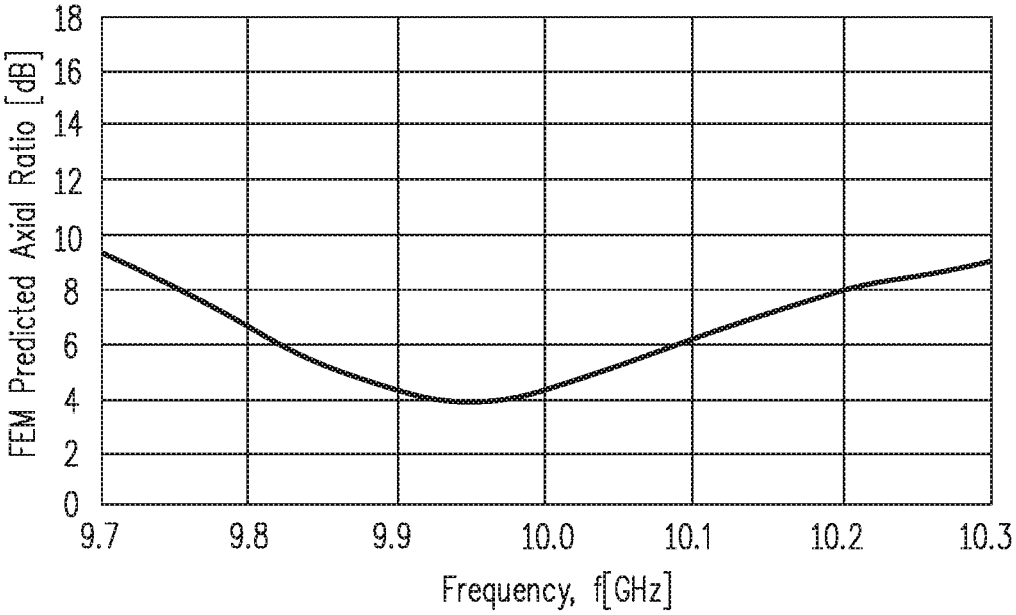

Performance of such antennas can be illustrated in FIGS. 6A and 6B. FIGS. 6A and 6B are illustrations of the performance of conformal antennas in accordance with examples of the disclosure.

FIG. 6A illustrates expected antenna gain performance through analysis of a finite element model to predict the performance of an antenna with a 4×4 array of dipole antenna elements. Similarly, FIG. 6B illustrates expected axial ratio performance of the 4×4 array of dipole antenna elements. Such an antenna is configured to operate near 10 GHz. Chart 600A of FIG. 6A shows the predicted gain of such an antenna, while Chart 600B of FIG. 6B shows the axial ratio of the antenna. An axial ratio of 0 dB signifies that an antenna is perfectly circularly polarized. Generally speaking, an axial ratio of less than 3 to 6 dB is considered acceptable for an antenna to be circularly polarized. As shown in FIG. 6B, the axial ratio is less than 4 dB as the antenna is operated near 10 GHz. The predicted gain is approximately 12.8 dBi as the antenna is operated near 10 GHz.

Figure 6C:
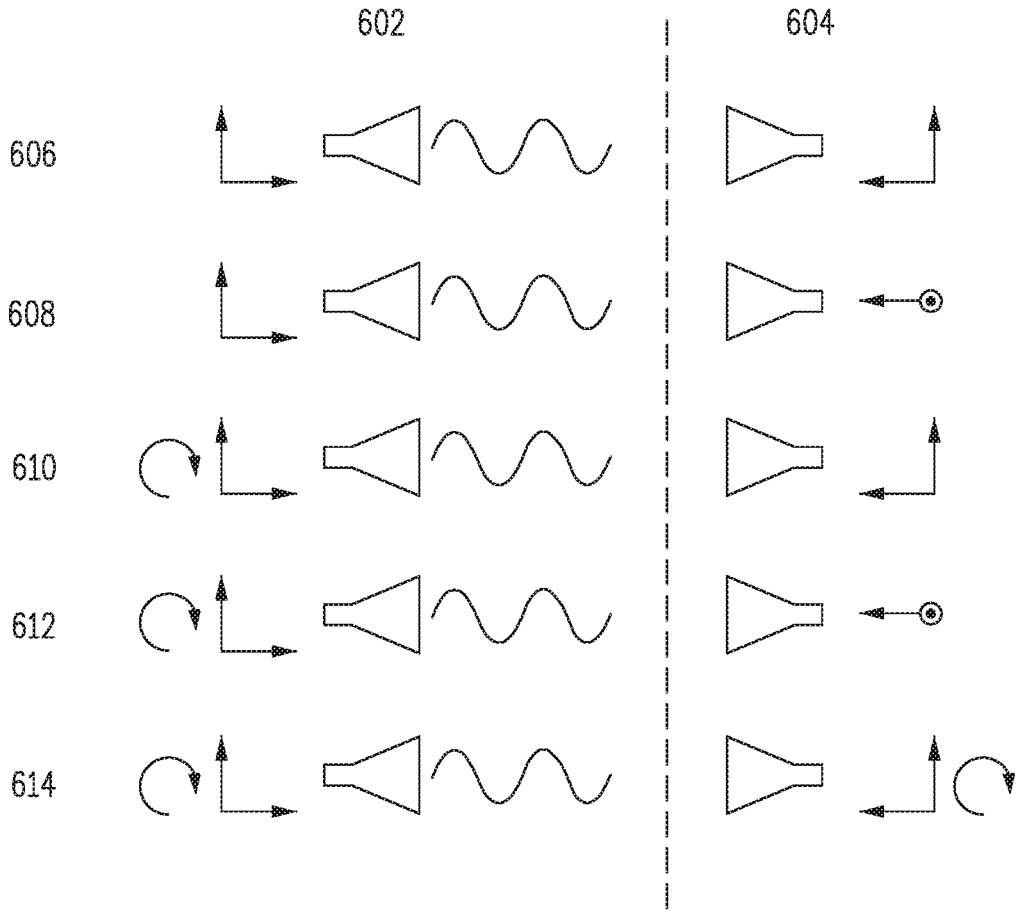
FIG. 6C illustrates the configurations of various different types of polarization.

FIG. 6C illustrates the configurations of various different types of polarization. Different types of transmitting and receiving antennas are shown in FIG. 6C. Column 602 illustrates transmitting antennas, while column 604 illustrates receiving antennas.

Pair 606 illustrates a vertical linear polarized transmitting antenna and a vertical linear polarized receiving antenna. As described herein, "vertical" and "horizontal" refer to the orientation of the antenna (e.g., how the antenna is positioned, such as whether the antenna is mounted in a vertical manner or mounted horizontally). As both antennas in pair 606 are vertical, they are oriented in a manner that results in 0% power loss (e.g., 0 dB). Thus, signals can be transmitted from the transmitted antenna to the receiving antenna without additional loss due to antenna orientation.

Pair 608 illustrates a vertical linear polarized transmitting antenna and a horizontal linear polarized receiving antenna. Such an orientation results in a 100% power loss. Accordingly, due to the orientation of the antennas, the receiving antenna would not be able to receive signals from the transmitting antenna.

Both antennas in pairs 606 and 608 are conventional linear polarized antennas. As shown in pair 608, such conventional antennas are sensitive to orientation, and as the orientation of an aircraft can change during operation, there can be situations where aircraft and control towers utilizing conventional antennas are unable to communicate. Additionally, as aircraft include curved surfaces, mounting antennas arrayed in a grid position with such conventional antennas on the curved surfaces of the aircraft will result in a configuration that always includes power loss due to least a portion of the antennas within the antenna array being oriented in a suboptimal manner.

By contrast, pairs 610 and 612 illustrate circular polarized transmitting antennas with vertical linear polarized and horizontal linear polarized receiving antennas, respectively. Each such configuration results in 50% power loss (e.g., 3 dB). Pairs 610 and 612 illustrate that a circular polarized antenna can still transmit signals 50% power regardless of the configuration of the linear polarized receiving antenna.

Pair 614 illustrates circular polarized transmitting and receiving antennas. As both antennas are circular polarized, there is no additional power loss due to antenna orientation. Furthermore, in contrast to pairs 606 and 608, a configuration with circular polarized transmitting and receiving antennas would not be sensitive to antenna orientation, maintaining 0% power loss regardless of orientation.

Figure 7:
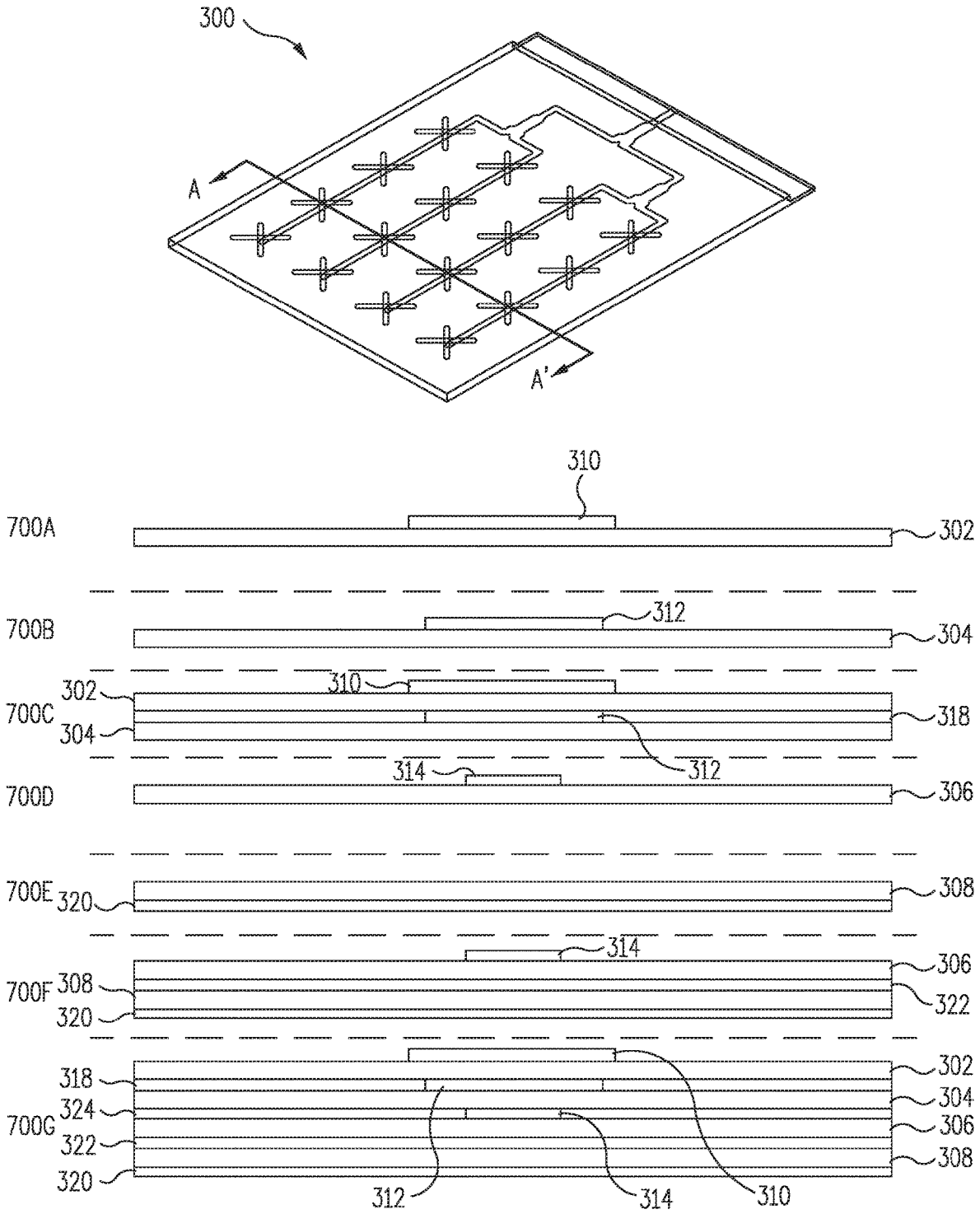
FIGS. 7 and 8 illustrate cutaway views of a technique for manufacturing the conformal antenna in accordance with examples of the disclosure.
Figure 8:
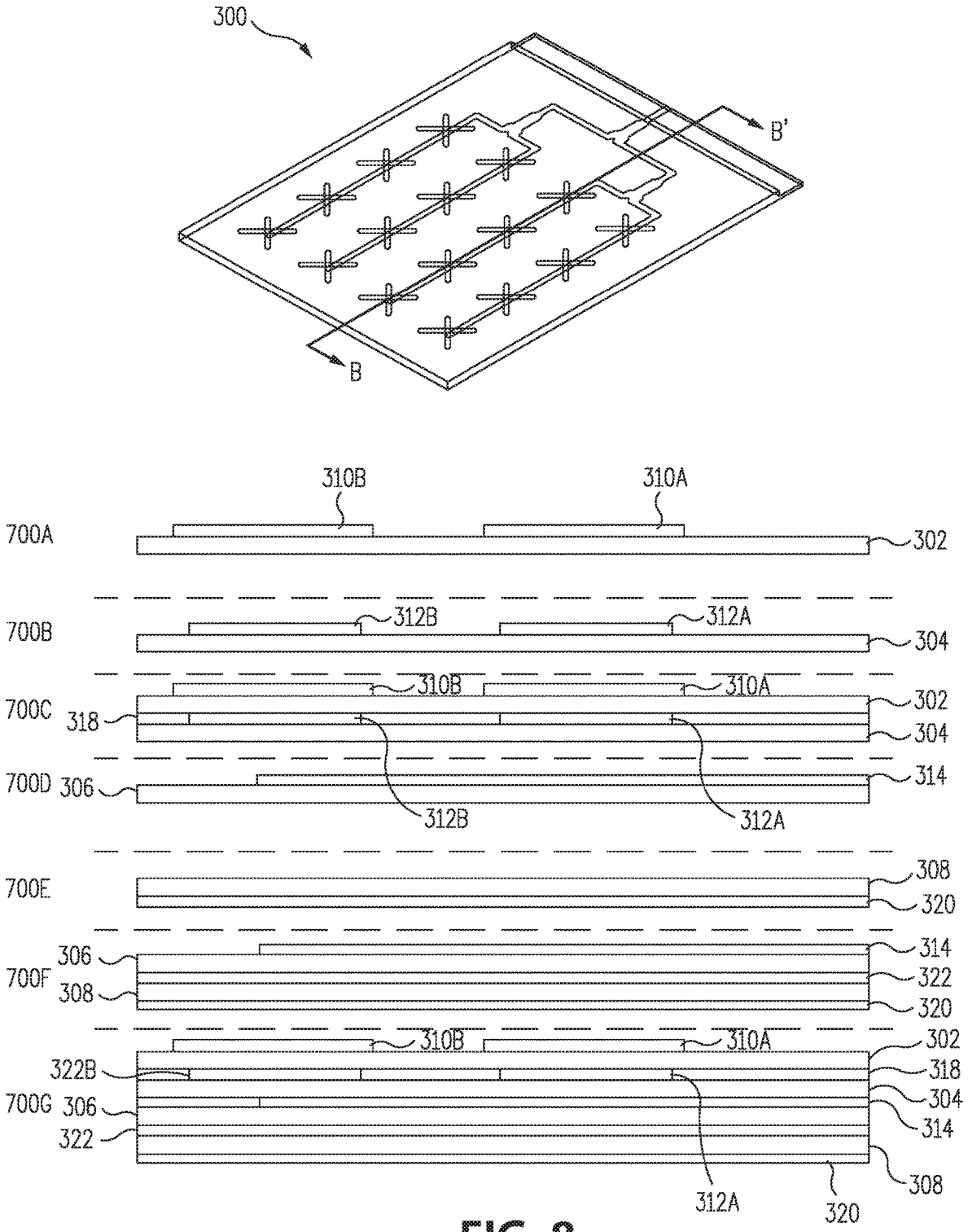

FIGS. 7 and 8 illustrate cutaway views of a technique for manufacturing the conformal antenna in accordance with examples of the disclosure. FIG. 7 illustrates manufacturing antenna 300 from a cutaway perspective along plane AA'. FIG. 8 illustrates manufacturing antenna 300 from a cutaway perspective along plane BB'. FIGS. 7 and 8 illustrate steps 700A-G used in the manufacture of conformal antennas. However, other examples can include additional or fewer steps to that shown in FIGS. 7 and 8.

In step 700A, antenna element 310 can be formed (e.g., patterned, deposited, and/or printed) on first dielectric layer 302. In step 700B, antenna element 312 can also be similarly formed on second dielectric layer 304.

In step 700C, the portions of first dielectric layer 302 and second dielectric layer 304 formed in steps 700A and 700B can be laminated together. For example, first dielectric layer 302 can be disposed on top of second dielectric layer 304. The dielectric layers 302 and 304 can be laminated together with adhesive 318, disposed between dielectric layers 302 and 304. In various other examples, any appropriate adhesive that holds together dielectric layers 302 and 304 can be utilized.

In step 700D, microstrip 314 can be formed on the third dielectric layer 306. Microstrip 314 can be an electrically conductive element formed (e.g., patterned, deposited, and/or printed) on the third dielectric layer 306 or a portion thereof.

In step 700E, ground plane 320 can be formed below the fourth dielectric layer 308. As described herein, microstrip 314 and ground plane 320, as well as antenna elements 310 and 312, are electrically coupled.

In step 700F, the portions of the third dielectric layer 306 (including microstrip 314) and the fourth dielectric layer 308 (including ground plane 320) formed in steps 700D and 700E can be laminated together by, for example, disposing the third dielectric layer 306 on top of the fourth dielectric layer 308. The third dielectric layer 306 and the fourth dielectric layer 308 can be laminated together with adhesive 322 and/or any other appropriate adhesive.

In step 700G, the first and second dielectric layers 302 and 304, respectively, laminated in step 700C and the third dielectric layer 306 and the fourth dielectric layer 308 laminated in step 700F can also be laminated together with, for example, adhesive 324 and/or any other appropriate adhesive.

Thus, the process described in FIGS. 7 and 8 can be performed to manufacture the conformal planar dipole antennas described herein. Such a process can provide a simply manufacturing process for the antennas as all layers are disposed in a stacked manner, allowing for manufacture of the antennas through simple processes such as deposition, etching, patterning, printing, and/or adhering of two or more layers.

Examples described above illustrate but do not limit the invention. It should also be understood that numerous modifications and variations are possible in accordance with the principles of the present invention. Accordingly, the scope of the invention is defined only by the following claims.

What is claimed is:

1. An antenna comprising:

a microstrip layer comprising a microstrip embedded within a composite substrate;

a second dipole layer disposed above the microstrip layer and comprising a second dipole antenna element electrically coupled to the microstrip, disposed over at least a portion of the microstrip, and oriented in a second direction; and a first dipole layer disposed above the second dipole layer and comprising a first dipole antenna element electrically coupled to the microstrip, disposed over at least a portion of the second dipole antenna element, and oriented in a first direction different from the second direction.

2. The antenna of claim 1, wherein the orientations of the first dipole antenna element and the second dipole antenna element are configured to cause circular polarization of signals provided by the antenna.

3. The antenna of claim 1, further comprising a ground plane layer disposed below the microstrip layer.

4. The antenna of claim 1, wherein the first dipole antenna element and the second dipole antenna element are elongated antenna elements.

5. The antenna of claim 1, wherein the second direction orients a major length of the second dipole antenna element at a substantially 90 degree angle to a major length of the first dipole antenna element.

6. The antenna of claim 1, wherein the first direction orients a major length of the first dipole antenna element at a substantially 45 degree angle to a major length direction of the microstrip.

7. The antenna of claim 1, further comprising:

a first dielectric layer disposed below the first dipole layer;

a second dielectric layer disposed below the second dipole layer; and a third dielectric layer disposed below the microstrip layer.

8. A method of manufacturing the antenna of claim 7, the method comprising:

forming the first dipole layer above the first dielectric layer;

forming the second dipole layer above the second dielectric layer;

forming the microstrip layer above the third dielectric layer;

laminating the first dielectric layer above the second dielectric layer; and laminating the second dielectric layer above the third dielectric layer.

9. The method of claim 8, further comprising forming a ground plane layer below a fourth dielectric layer and laminating the fourth dielectric layer below the third dielectric layer.

10. An antenna array comprising:

a microstrip layer comprising a microstrip embedded within a composite substrate;

a second dipole layer disposed above the microstrip layer and comprising a plurality of second dipole antenna elements, wherein each of the second dipole antenna elements is electrically coupled to the microstrip, disposed over a portion of the microstrip, and oriented in a second direction; and a first dipole layer disposed above the second dipole layer and comprising a plurality of first dipole antenna elements, wherein each of the first dipole antenna elements is electrically coupled to the microstrip, disposed over a portion of one of the second dipole antenna elements, and oriented in a first direction different from the second direction.

11. The antenna array of claim 10, wherein each of the first dipole antenna elements is disposed over a portion of one of the second dipole antenna elements to form a coupled dipole antenna.

12. The antenna array of claim 11, wherein each of the coupled dipole antennas is configured to cause circular polarization of signals provided from the microstrip.

13. The antenna array of claim 11, wherein the second direction orients, for the coupled dipole antenna, a major length of the second dipole antenna element at a substantially 90 degree angle to a major length of the first dipole antenna element.

14. The antenna array of claim 10, further comprising a ground plane layer disposed below the microstrip layer.

15. The antenna array of claim 10, wherein the first dipole antenna elements and the second dipole antenna elements are elongated antenna elements.

16. The antenna array of claim 10, wherein the first direction orients a major length of at least one of the first dipole antenna elements at a substantially 45 degree angle to a major length direction of the microstrip.

17. The antenna array of claim 10, wherein the microstrip comprises a first strip portion, a second strip portion, and a power divider coupling the first strip portion to the second strip portion.

18. The antenna array of claim 17, wherein at least one first antenna dipole elements and at least one second antenna dipole elements is disposed over each of the first strip portion and the second strip portion.

19. An aircraft comprising the antenna array of claim 10, wherein the aircraft further comprises:

a fuselage; and a wing, wherein the antenna array is coupled to the fuselage and/or the wing.

20. The aircraft of claim 19, wherein the antenna array is disposed on a curved surface of the fuselage and/or the wing.

* * * * *